US010900730B1

(12) United States Patent
Loveday, IV et al.

(10) Patent No.: US 10,900,730 B1
(45) **Date of Patent: *Jan. 26, 2021**

(54) FIREARM MAGAZINE LOADER

(71) Applicant: Elite Tactical Systems Group, LLC, Cheyenne, WY (US)

(72) Inventors: George E. Loveday, IV, Knoxville, TN (US); George E. Loveday, III, Knoxville, TN (US)

(73) Assignee: Elite Tactical Systems Group, LLC, Cheyenne, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/733,295

(22) Filed: Jan. 3, 2020

Related U.S. Application Data

(63) Continuation of application No. 16/398,185, filed on Apr. 29, 2019, now abandoned, which is a continuation of application No. 15/851,687, filed on Dec. 21, 2017, now Pat. No. 10,317,154.

(60) Provisional application No. 62/438,451, filed on Dec. 22, 2016.

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/82
USPC ..... 42/87
See application file for complete search history.

(56) References Cited

U.S. PATENT DOCUMENTS 4,574,511 A * 3/1986 Csongor ..... F41A 9/84 42/87
4,614,052 A * 9/1986 Brown ..... F41A 9/83 42/50
4,706,402 A * 11/1987 Csongor ..... F41A 9/84 42/87
4,719,715 A * 1/1988 Howard ..... F41A 9/83 42/87
4,872,279 A * 10/1989 Boat ..... F41A 9/67 42/90
4,993,180 A * 2/1991 Upchurch ..... F41A 9/83 42/87
5,355,606 A * 10/1994 Origoni ..... F41A 9/83 42/87
5,402,594 A * 4/1995 Switzer ..... F41A 9/83 42/87
6,286,243 B1 * 9/2001 Hinton ..... F41A 9/83 42/87

(Continued)

OTHER PUBLICATIONS

TheFirearmBlog.com, Ray I., SmitLoad Glock Mag Loader, https://www.thefirearmblog.com/blog/2016/04/21/225273/, Apr. 21, 2016.

*Primary Examiner* — Michelle Clement
(74) *Attorney, Agent, or Firm* — J. Kenneth Hoffmeister

(57) ABSTRACT

A firearm magazine loader. The loader includes a body having a linear projection extending from the top of the loader for holding rounds of ammunition and an optional plunger for pushing the rounds into a magazine. The loader accommodates and centers a wide variety of magazines due to a self-centering mechanism incorporated into the body. An angled feed channel pivots the rounds into position to slide under the feed lips of a magazine to significantly reduce the insertion force required and allow a double stack magazine to be quickly filled to capacity with minimal effort.

20 Claims, 13 Drawing Sheets

(56) References Cited

U.S. PATENT DOCUMENTS

| | | | | |
|---|---|---|---|---|
| D477,047 | S * | 7/2003 | Springer | D22/108 |
| D527,067 | S * | 8/2006 | Sellars | D22/108 |
| 7,117,626 | B1 * | 10/2006 | Alzamora | F41A 9/65 42/108 |
| 7,497,044 | B2 * | 3/2009 | Cammenga | F41A 9/67 42/49.01 |
| D615,143 | S * | 5/2010 | Fitzpatrick | D22/108 |
| 7,805,874 | B2 | 10/2010 | Tal | |
| 8,484,874 | B2 * | 7/2013 | Kim | F41A 9/66 42/49.01 |
| 8,931,199 | B1 * | 1/2015 | Cauley, Jr. | F41A 9/83 42/87 |
| 9,003,687 | B2 * | 4/2015 | Cauley, Jr. | F41A 9/83 42/88 |
| 9,068,787 | B1 * | 6/2015 | Jensen | F41A 9/83 |
| 9,182,185 | B2 * | 11/2015 | Hatch | F41A 9/67 |
| 9,273,917 | B1 * | 3/2016 | Buckner | F41A 9/83 |
| D753,781 | S * | 4/2016 | Cauley, Jr. | D22/108 |
| D755,325 | S * | 5/2016 | Cauley, Jr. | D22/108 |
| 9,335,108 | B2 * | 5/2016 | Cauley, Jr. | F41A 9/83 |
| 9,354,008 | B1 * | 5/2016 | Cifers | F41A 9/83 |
| D770,588 | S * | 11/2016 | Cauley, Jr. | D22/108 |
| 9,574,836 | B1 * | 2/2017 | Cauley, Jr. | F41A 9/83 |
| 9,612,070 | B2 * | 4/2017 | Hatch | F41A 9/67 |
| 9,618,286 | B1 | 4/2017 | Plate | |
| D790,030 | S * | 6/2017 | Ulbrich | D22/108 |
| 9,689,633 | B1 | 6/2017 | Plate | |
| 9,709,352 | B1 * | 7/2017 | Hess | F41A 9/84 |
| 9,719,741 | B1 * | 8/2017 | Cifers | F41A 9/83 |
| 9,739,552 | B1 | 8/2017 | Plate | |
| D799,632 | S * | 10/2017 | Ulbrich | D22/108 |
| 9,797,669 | B1 | 10/2017 | Plate | |
| D815,235 | S * | 4/2018 | Grego | D22/108 |
| 9,933,220 | B1 | 4/2018 | Plate | |
| 9,939,219 | B1 * | 4/2018 | Ulbrich | F41C 7/00 |
| 9,964,373 | B2 * | 5/2018 | Mills | F41A 9/83 |
| D821,534 | S * | 6/2018 | Couie | D22/108 |
| 9,989,324 | B1 * | 6/2018 | Ulbrich | F41C 7/00 |
| D827,757 | S * | 9/2018 | Hefer | D22/108 |
| D829,293 | S * | 9/2018 | Hefer | D22/108 |
| D829,295 | S * | 9/2018 | Buckner | D22/108 |
| 10,126,077 | B1 * | 11/2018 | Glover | F41A 9/83 |
| 10,151,547 | B1 * | 12/2018 | Plate | F41A 9/83 |
| D839,376 | S * | 1/2019 | Hefer | D22/108 |
| 10,175,017 | B2 * | 1/2019 | Cottrell | F41A 9/83 |
| 10,190,836 | B2 * | 1/2019 | Ulbrich | F41C 7/00 |
| D841,757 | S * | 2/2019 | Russell | D22/108 |
| 10,215,516 | B2 * | 2/2019 | Hefer | F41A 9/83 |
| 10,222,155 | B2 * | 3/2019 | Hefer | F42B 39/26 |
| D845,424 | S * | 4/2019 | Hefer | D22/108 |
| 10,247,499 | B2 * | 4/2019 | Cifers | F41A 9/83 |
| 10,317,154 | B1 * | 6/2019 | Loveday, IV | F41A 9/83 |
| 10,330,411 | B2 * | 6/2019 | Cottrell | F41A 9/83 |
| 10,345,065 | B2 * | 7/2019 | Roe | F41A 9/83 |
| D861,822 | S * | 10/2019 | Hellyar | D22/108 |
| 10,508,875 | B2 * | 12/2019 | Hatch | F41A 9/83 |
| 10,598,453 | B2 * | 3/2020 | Underwood | F41A 9/67 |
| 10,598,455 | B2 * | 3/2020 | Plate | F41A 9/83 |
| 10,641,566 | B2 * | 5/2020 | Cottrell | F41A 9/83 |
| 2003/0046854 | A1 | 3/2003 | Urchek | |
| 2014/0033592 | A1 | 2/2014 | Fiorucci | |

* cited by examiner

FIREARM MAGAZINE LOADER

BACKGROUND

For all the obvious benefits, increasing the capacity of firearm magazines has consequences. Operating with more rounds of ammunition, high capacity magazines have higher spring tensions. In double stack magazines, where the magazine funnels two columns of rounds into a single column at the feed lips, the spring force necessary to overcome the binding at the transition point is significant. In fact, the amount of force necessary to insert a round into the magazine increases with each round. This makes fully loading rounds into high capacity double stack magazines difficult. When loading multiple high capacity magazines, it is not uncommon for users to experience pain due to the amount of stress placed on the user's fingers and thumbs during the loading process.

Another consequence is the amount of time required to load high capacity magazines. Individually loading rounds into a magazine is a time consuming process, in and of itself. With the higher forces involved, individually loading rounds into high capacity magazines takes even longer. It is with respect to these and other considerations that the present invention has been made.

BRIEF DESCRIPTION OF THE DRAWINGS

Further features, aspects, and advantages of the present disclosure will become better understood by reference to the following figures, wherein elements are not to scale so as to more clearly show the details and wherein like reference numbers indicate like elements throughout the several views.

BRIEF SUMMARY

Figure 1:
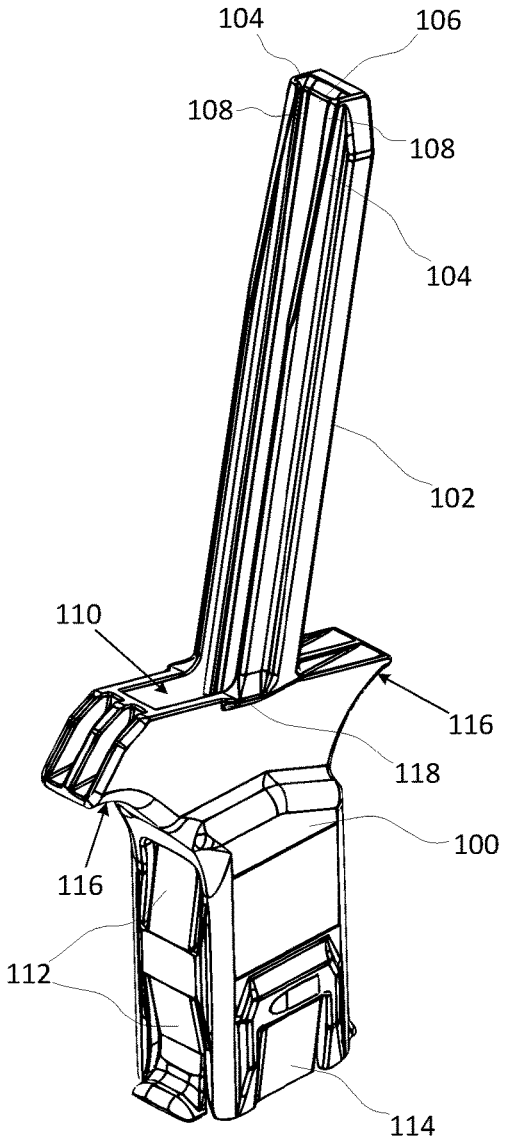
FIG. 1 is a front perspective view of an embodiment of a handheld firearm magazine loader according to the present invention.

The following summary discusses various aspects of the invention described more fully in the detailed description and claimed herein. It is not intended to be limiting and should not be used to limit the claimed invention to only such aspects or to require the invention to include all such aspects.

The magazine loader includes a body having a linear projection and an optional plunger. Generally, the body is shaped to be held in a user's hand. The projection extends from the top of the body. A set of rails extend outwardly from the projection and, together with the back wall, serve as the side walls defining a channel. A rib extends from each of the side walls into the channel. The rib is positioned and dimensioned to engage the extractor groove of the casing of a round of ammunition. In use, the projection may be used to pick up multiple rounds in a single motion from an ammunition tray to speed up the loading process.

The top end of the body defines a feed opening for receiving the rounds being fed from projection. Likewise, the bottom end of the body defines a well opening for receiving the feed end of a magazine. The front of the body includes at least one frontal positioner that can flex to accommodate magazines of different front-to-back dimensions. At least one side of the body defines a lateral positioner that can flex to accommodate magazines of different side-to-side dimensions. In various embodiments, the frontal positioner(s) and the lateral positioner(s) have one portion extending from or connected to the body to form a flex point with the remainder of the positioner being free.

Turning to the internal geometry of the loader, the body of the loader defines a round positioning chamber and a magazine well. The round positioning chamber has a multi-section front wall and a multi-section rear wall. The front wall top section is substantially parallel to the angle of the projection. The rear wall top section is a continuation of the projection rear wall. Collectively the middle and bottom sections form the lower wall portions of each wall. The front wall bottom section and the rear wall middle and bottom sections are angled toward the rear of the body. For the front wall, the lower portion forms a generally concave shape. For the rear wall, the lower portion forms a generally convex shape.

The bottom end of the body defines the magazine opening of the magazine well that receives the magazine to be loaded. Because of dimensional variations in magazines for different firearms, the portion of the loader body defining the magazine well includes a set of feed lip guides, the frontal positioner(s), and the lateral positioner(s) to properly position and securely retain magazines in the magazine well. The pressure applied by the frontal positioner(s) ensures that the magazine is pushed against the back wall of the magazine well. The frontal positioner(s) and the feed lip guides cooperate to properly align the feed end of the magazine with the feed opening at the top of the loader body. The lateral positioner(s) generally center the magazine within the magazine well, such positioning is less critical to proper operation of the loader.

The plunger includes a top face that provides a gripping surface. A through-opening extends through the plunger from top to bottom. The through-opening is shaped to operatively engage with the projection of the loader so as to allow the plunger to slide up and down on the projection. The interface between the through-opening and the projection maintains the proper orientation of the plunger. A tab extends below the plunger to create a push bar for engaging the rounds of ammunition carried by the projection. The length of the push bar is generally equal to the depth of the round positioning chamber. The bottom of the push bar is contoured to cradle a round of ammunition.

DETAILED DESCRIPTION

Aspects of a firearm magazine loader are described herein and illustrated in the accompanying figures. The loader includes a body having a linear projection extending from the top of the loader for holding rounds of ammunition and an optional plunger for pushing the rounds into a magazine. The loader accommodates and centers a wide variety of magazines due to a self-centering mechanism incorporated into the body. An angled feed channel pivots the rounds into position to slide under the feed lips of a magazine to significantly reduce the insertion force required and allow a double stack magazine to be quickly filled to capacity with minimal effort.

FIG. 1 is a front perspective view of an embodiment of the magazine loader illustrating aspects of the present invention. Additional views of the loader are shown in FIGS. 2-6. The magazine loader includes a body 100 having a linear projection 102 and an optional plunger (shown in FIGS. 8-10). The projection 102 extends from the top of the body. A set of rails 104 extend outwardly from the projection 102 and, together with the back wall 106, serve as the side walls defining a channel. A rib 108 extends from each of the side walls into the channel. The rib 108 is positioned and dimensioned to engage the extractor groove of the casing of a round of ammunition. In use, the projection 102 may be used to pick up multiple rounds in a single motion from an ammunition tray to speed up the loading process. Alternatively, individual rounds may be manually loaded into the projection. One optional aspect of the projection includes hinging the projection allowing it fold and reduce the overall length of the loader when not in use. The length of the projection 102 can be varied to hold a selected number of rounds for loading at one time without departing from the scope and spirit of the present invention. By way of non-limiting examples, the projection may be sized to hold five or ten rounds at a time.

The top end of the body 100 defines a feed opening 110 for receiving the rounds being fed from projection. Likewise, the bottom end of the body defines a well opening (shown in FIG. 7) for receiving the feed end of a magazine. The front of the body includes at least one frontal positioner 112 that can flex to accommodate magazines of different front-to-back dimensions. At least one side of the body defines a lateral positioner 114 that can flex to accommodate magazines of different side-to-side dimensions. In various embodiments, the frontal positioner(s) 112 and the lateral positioner(s) 114 have one portion extending from or connected to the body 100 to form a flex point with the remainder of the positioner being free. In a typical embodiment, the frontal positioner(s) 112 and the lateral positioner(s) 114 are tabs having one edge portion anchored to the body 100 with the remaining three edges unconnected to the body 100.

Generally, the body 100 is shaped to be held in a user's hand. The front and rear portions at the top of the body 100 extend forward and rearward, respectively, to engage the user's hand and provide surfaces 116 to push against when loading a magazine. In various embodiments, the body 100 has the same general shape as the grip of a handgun. In the illustrated embodiment, the body 100 has the same general shape as the grip of an automatic pistol.

Figure 7:
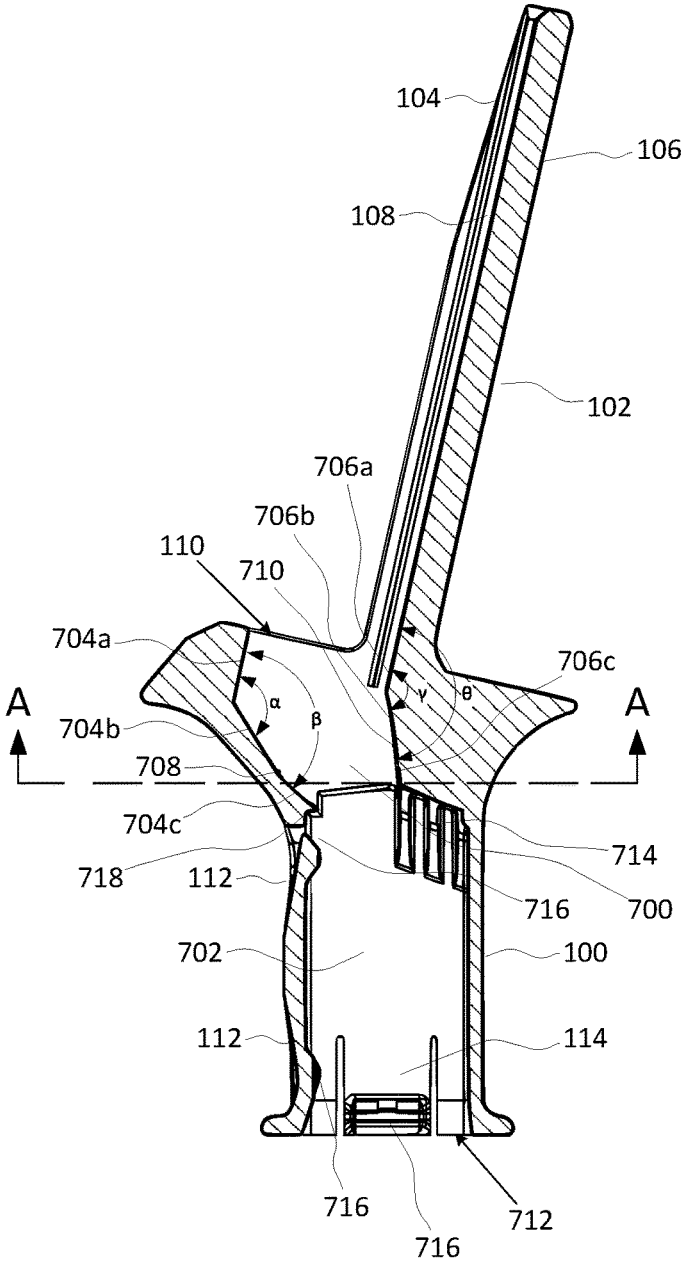
FIG. 7 is a sectional view of the loader of FIG. 1, taken along line B-B of FIG. 6.

FIG. 7 is a sectional side elevation view showing the internal geometry of the loader. The body 100 of the loader defines a round positioning chamber 700 and a magazine well 702. The round positioning chamber 700 has a multi-section front wall 704*a-c* and a multi-section rear wall 706*a-c*. The front wall top section 704*a* is substantially parallel to the angle of the projection. The rear wall top section 706*a* is a continuation of the projection rear wall 106. In other words, the rear wall top section 706*a* is at the same angle as the projection 102. The distance between the front wall top section 704*a* and the rear wall top section 706*a* defines the maximum length of a round that can feed into a magazine using the loader. In general, this distance is set to accommodate the longest round of ammunition in the caliber(s) for which the loader is designed. As illustrated, the top part of the front wall is longer than the top part of the rear wall.

Collectively the middle and bottom sections form the lower wall portions of each wall. The front wall bottom section 704*b* and the rear wall middle and bottom sections 706*b*, 706*c* are angled toward the rear of the body 100. Generally, the rear wall 706*c* is configured to terminate at or slightly forward relative to the position of the front edge of the feed lips of a magazine inserted into the loader. For the front wall, the lower portion forms a generally concave shape. For the rear wall, the lower portion forms a generally convex shape. The angle of the front wall is much sharper than the angle of the rear wall. In various embodiments, the middle section 704*b*, 706*b* gradually curve into the bottom sections 704*c*, 706*c*, with the transition points 708, 710 at the approximate midpoint of the distance from the end of the top section to the magazine well 702. This angular change in the walls facilitates the smooth rotation of the rounds to achieve the proper angle for insertion under the feed lips while pressure is applied to the column of rounds in the direction of the projection with minimal binding.

By way of example, in an embodiment of the loader configured to load 9 mm ammunition, the angle $\alpha$ between the front wall top section 704*a* and the front wall middle section 704*b* is approximately 126°, the angle $\beta$ between the front wall top section 704*a* and the front wall middle section 704*b* is approximately 124°, the angle $\gamma$ between the rear wall top section 706*a* and the rear wall middle section 706*b* is approximately 163°, and the angle $\theta$ between the rear wall top section 706*a* and the rear wall bottom section 706*c* is approximately 161°. This small angular change (approximately in the range of 1° to 3°) in the walls facilitates the smooth rotation of the rounds to achieve the proper angle for insertion under the feed lips while pressure is applied to the column of rounds in the direction of the projection with minimal binding. In other embodiments, the middle and bottom wall sections of the front wall and/or the rear wall are replaced with a single wall section, at the cost of an increased tendency for binding requiring the user to adjust the direction and/or amount of force applied to the column of rounds. It should be appreciated that the above listed angles are exemplary of a particular embodiment, and that different angles may be used to accommodate different types and sizes of ammunition. As such, the angles listed herein should not be construed as limiting in any way.

The bottom end of the body 102 defines the magazine opening 712 of the magazine well that receives the magazine to be loaded. Because of dimensional variations in magazines for different firearms, the portion of the loader body defining the magazine well includes a set of feed lip guides 714, the frontal positioner(s) 112, and the lateral positioner(s) 114 to properly position and securely retain magazines in the magazine well. The set of feed lip guides 714 are located proximate to the top of each side wall of the magazine well.

The feed lip guides 714 engage the feed lips of a magazine that is inserted into the magazine well of the loader and center the magazine within the magazine well 702. This properly aligns the feed lips of the magazine with the feed opening 110 at the top of the loader body 100. In various embodiments, the feed lip guides 714 are substantially horizontal ridges proximate to the top of the magazine well. In the illustrated embodiment, the feed lip guides 714 include one or more vertical ridges running from the top of the magazine well to a position down the side wall of the magazine. This allows for more flexibility in properly centering a number of different magazines. Extending the feed lip guides 714 down the side walls of the magazine well allows magazines that are not inserted fully to the top of the magazine well to be centered. In various embodiments, the lateral positioners may be omitted without adversely affecting the loading operation where the feed lip guides provide adequate centering of the top of the magazine for proper operation of the loader.

The distances between the front and back walls and the side walls of the magazine well dictate, respectively, the maximum front-to-back and side-to-side dimensions of a magazine that can be used with the loader. The minimum front-to-back and side-to-side dimensions of a magazine that can be securely retained by the loader are defined by the frontal positioner(s) 112 and the lateral positioner(s) 114. More specifically, the inner face of each of the frontal positioner(s) and the lateral positioner(s) include an inwardly projecting ridge 716 configured to engage the sides of a magazine inserted in the well opening. These ridges define a smaller contact area between the positioner and the magazine to reduce the amount of friction during insertion and removal of the magazine from the well opening. The effective distance between the front and back walls and between the side walls is reduced by height of the ridge(s) 716. The ridges 716 occupy enough space and make sufficient contact to allow the magazine well to securely retain smaller magazines. In order to accommodate larger magazines, the positioners 112, 114 flex outwardly by bending proximate to the connected end. The thickness of the connected end of the positioner 112, 114 is selected to determine the amount of spring force that the positioners are capable of applying to center the magazine.

The pressure applied by the frontal positioner(s) ensures that the magazine is pushed against the back wall of the magazine well. The frontal positioner(s) and the feed lip guides cooperate to properly align the feed end of the magazine with the feed opening at the top of the loader body. The lateral positioner(s) generally center the magazine within the magazine well, such positioning is less critical to proper operation of the loader.

The proper positioning of the magazine within the well opening and ease of use is a function of the ridge height and the thickness of the connected end of the positioner 112, 114. Too much spring force makes insertion and removal of a magazine difficult. On the other hand, too little spring force may be insufficient to retain and/or properly position the magazine within the well opening. In various embodiments, the balance between proper positioning and ease of use is achieved by increasing ridge height while decreasing the thickness of the connected end of the positioner 112, 114. By increasing the ridge height, the positioners are forced to flex outwardly more for any given magazine, which results in increased spring forces being applied. However, the reduced thickness of the connected end of the positioner 112, 114 means the overall spring force applied is smaller making insertion and removal of the magazine easier.

Another aspect of the loader is that the bottom of the front wall of the round positioning chamber is configured with a lip 718 that extends out over the front wall of a magazine. In other words, the lip 718 creates a recess that receives the front wall of the magazine and prevents the rounds from coming into contact with the top edge of the magazine front wall. This prevents binding that occurs when a round catches on the top edge of the magazine front wall. This binding has been found to be particularly problematic with metal magazines.

Figure 8:
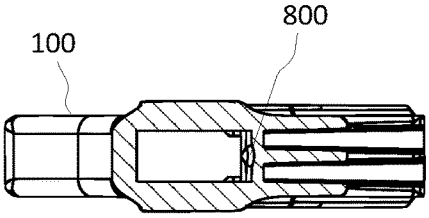
FIG. 8 is a sectional view of the loader of FIG. 1, taken along line A-A of FIG. 5.

FIG. 8 illustrates an optional aspect of the loader showing a groove 800 in the rear wall of the round positioning chamber. The optimal angle for at least the rear wall varies slightly based on the length of the rounds being loaded. Depending on the angle selected, some ammunition may show a greater tendency to bind during loading. The groove 800 allows the rear wall to flex slightly in response to a substantially lateral force transferred through the rear of the round. This slight give tends to reduce the likelihood of the rounds binding because the rear wall gives rather than preventing movement of the rear of the round. Over time, this frictional engagement tends to cause wear to the round positioning chamber rear wall when the loader is fabricated from softer materials (e.g., plastic). Thus, even without the groove 800, the loader is self-correcting to accommodate differences in the ammunition being loaded. For hard materials (e.g., metal) and during the self-correction phase, the groove 800 reduces the likelihood of binding.

Figure 9:
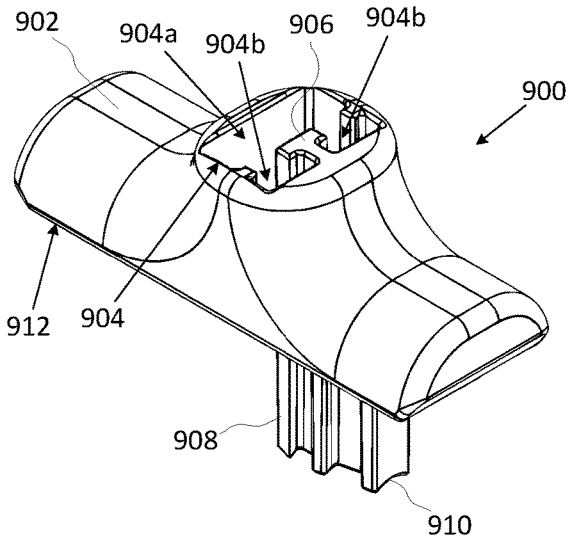
FIG. 9 is a top perspective view of an embodiment of the plunger for use with loader of FIG. 1.

FIG. 9 is a top plan view of one embodiment of a plunger 900 of the loader. The plunger 900 includes a top face 902 that provides a gripping surface. In the illustrated embodiment, the top face 902 curved to be comfortably gripped by a user's fingers. A through-opening extends through the plunger from top to bottom. The through-opening 904 is shaped to operatively engage with the projection 102 of the loader so as to allow the plunger 900 to slide up and down on the projection 102. The interface between the through-opening 904 and the projection 102 maintains the proper orientation of the plunger 904. An optional aspect of the interface between the through-opening 904 and the projection 102 is sizing the through-opening 904 to provide a small amount of play that allows the user to rock the plunger 900 slightly to release tension and overcome a bind created when attempting to push rounds into a magazine.

In the illustrated embodiment, the through-opening 904 has a main opening **904*a* accepts the rails and back wall of the projection. Two smaller openings 904*b*, or slots, expand the main opening 904*a* to accommodate the side walls 104 of the projection 102. This arrangement creates a tab 906 between the two slots 904*b* that rides in the channel of the projection. The tab 906 extends below the plunger 902 to create a push bar 908 for engaging the rounds of ammunition carried by the projection 102. The length of the push bar 908 is generally equal to the depth of the round positioning chamber 702. In other words, the length of the push bar 908 is sufficient to push a round through the entire round positioning chamber 702. The bottom 910 of the push bar 908 is contoured to cradle a round of ammunition. Further, in various embodiments, the push bar bottom 910 is curved or multi-sectional. Generally, the middle section is parallel to the bottom face 912 of the plunger 900 and provides the primary point of contact applying force to the rounds. The two outer sections of the push bar bottom 910 are angled back towards the bottom face 912 of the plunger 910**. These angled sections provide room for the rounds to rotate in the round positioning chamber to minimize binding while still providing a contact surface, as necessary.

Figure 2:
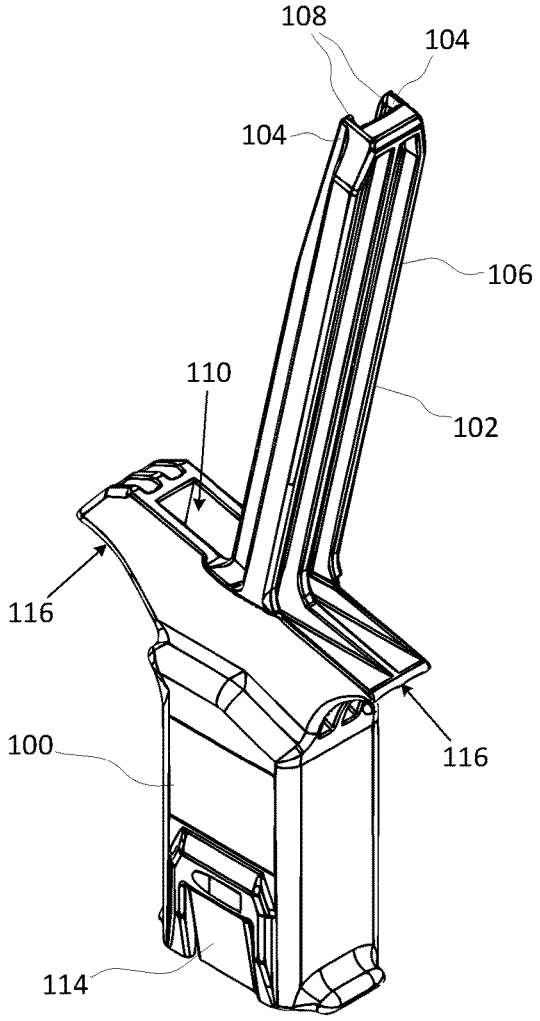
FIG. 2 is a rear perspective view of the loader of FIG. 1.
Figure 3:
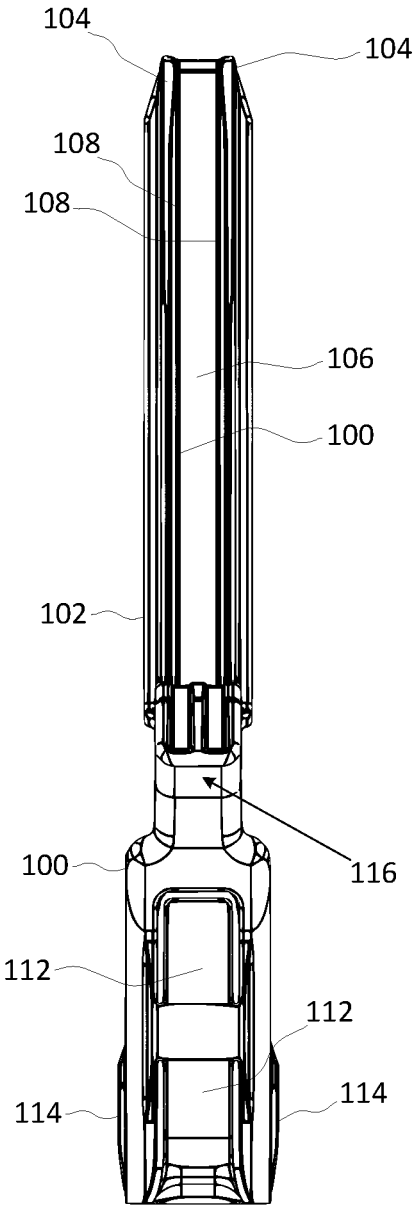
FIG. 3 is a front elevation view of the loader of FIG. 1.
Figure 4:
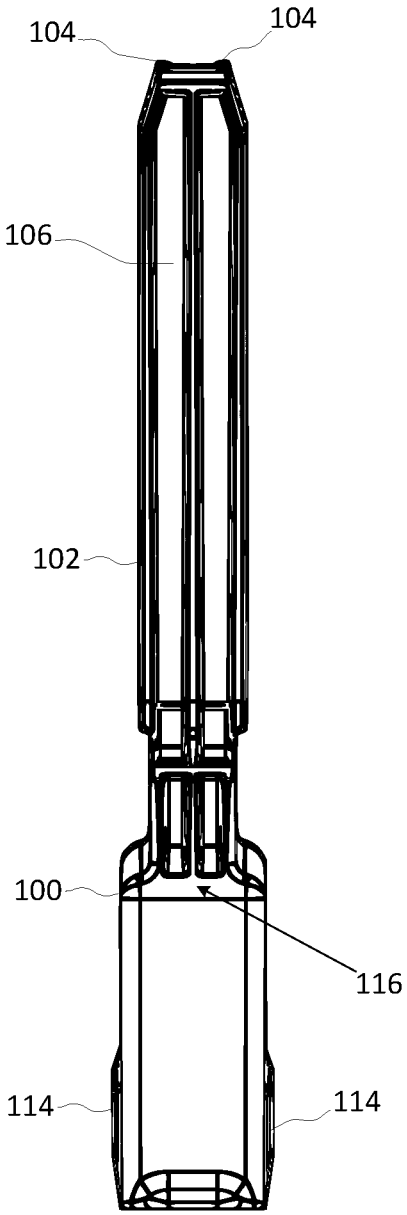
FIG. 4 is a rear elevation view of the loader of FIG. 1.
Figure 5:
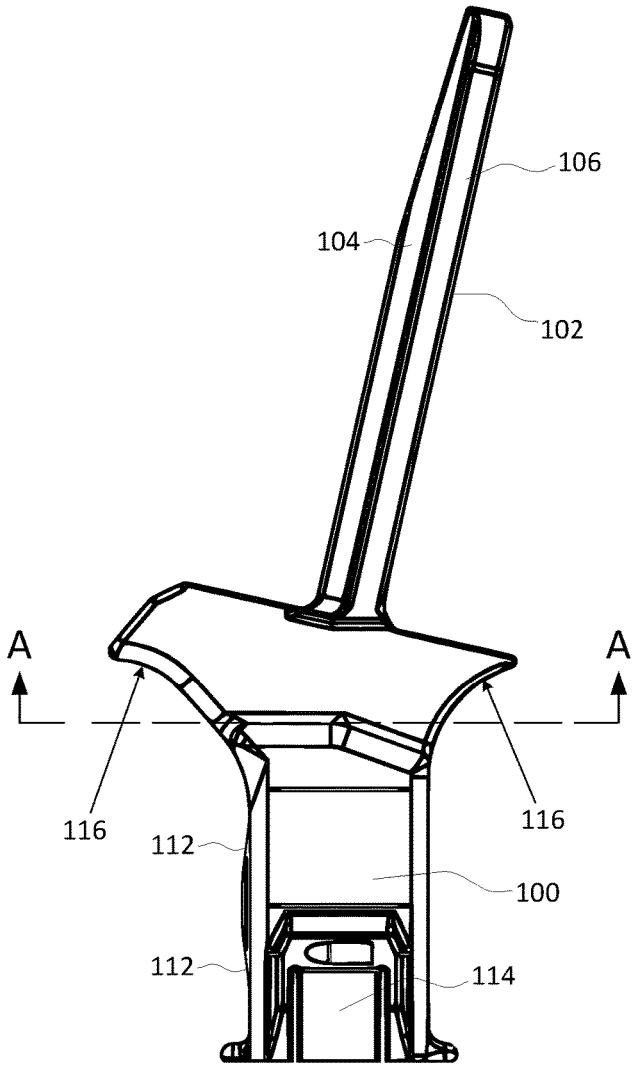
FIG. 5 is a side elevation view of the loader of FIG. 1.
Figure 6:
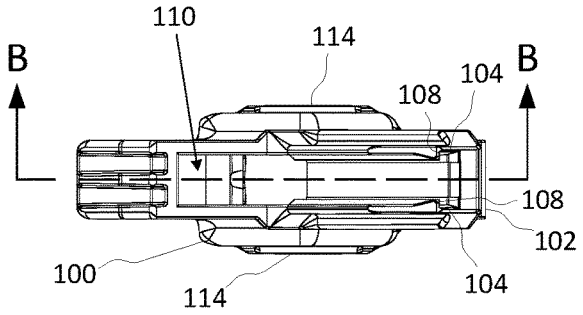
FIG. 6 is a top plan view of the loader of FIG. 1.
Figure 10:
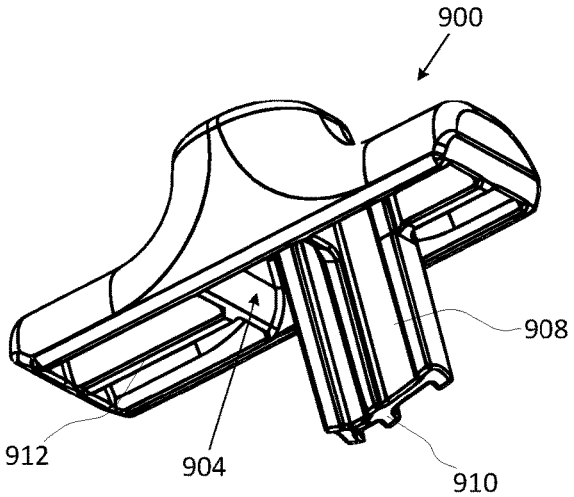
FIG. 10 is a bottom perspective view of the plunger of FIG. 9.
Figure 14:
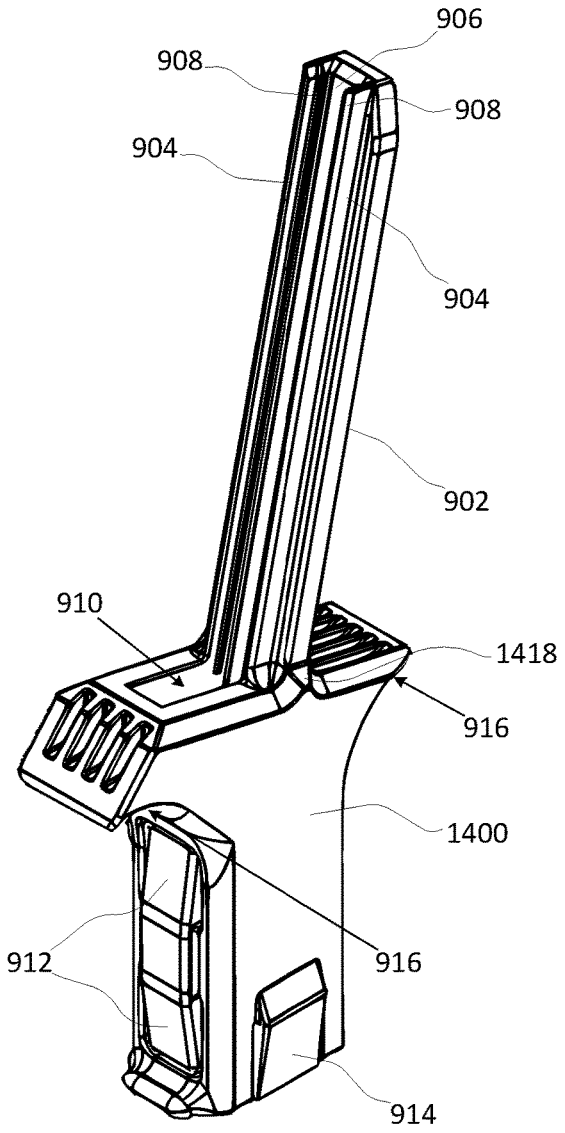
FIG. 14 is a front perspective view of an alternate embodiment of a handheld firearm magazine loader according to the present invention.
Figure 15:
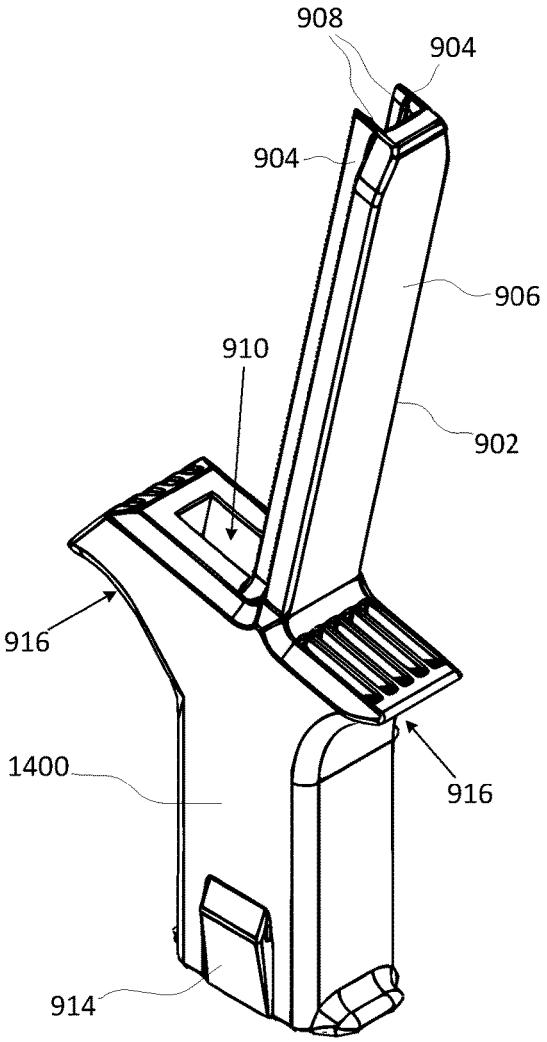
FIG. 15 is a rear perspective view of the loader of FIG. 14.

FIG. 10 is a bottom plan view of one embodiment of a plunger of the loader. In the illustrated embodiment, the bottom face 912 of the plunger is substantially flat to complement the substantially flat top face of the main component of the loader. An optional aspect of the loader is chamfering the corners of the top face of the loader body of the loader and the bottom face of the plunger to reduce the likelihood of pinching the user's hand or fingers when the plunger and the loader body are squeezed together. One optional aspect of the loader to minimize the likelihood of pinching the user's hand or fingers is adding a guard or spacer to the plunger or the loader body proximate to the plunger that prevents the bottom face of the plunger from coming into contact with the top face of the loader body. An example of such a guard 118 on the loader body is seen in FIGS. 1 and 2. An example of such a spacer 1418 on the loader body is seen in FIGS. 14 and 15.

Figure 11:
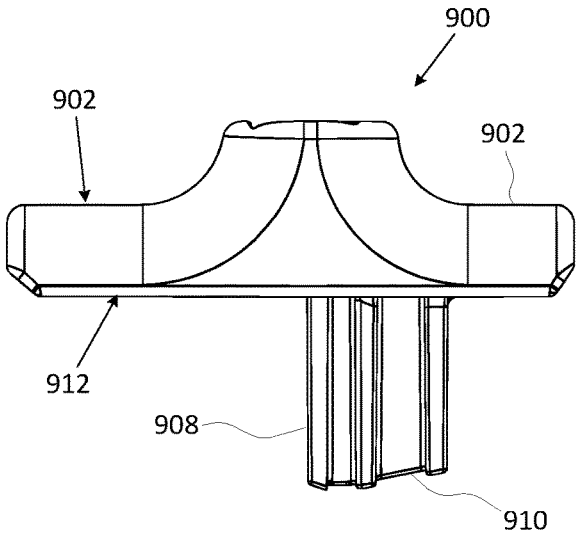
FIG. 11 is a side elevation view of the plunger of FIG. 9.
Figure 12:
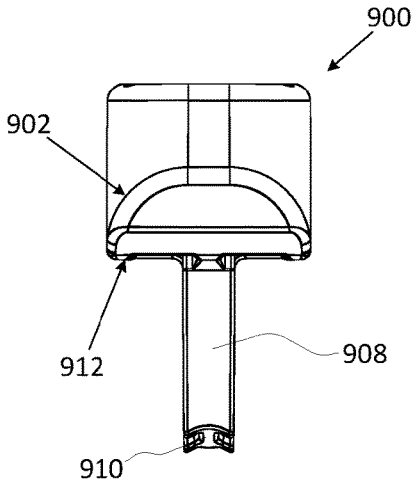
FIG. 12 is a front elevation view of the plunger of FIG. 9.

Aspects of the plunger 900 include making the plunger an independent component of the loader (i.e., not permanently connected to the loader body or projection). This allows the plunger 900 to be removed so one or more rounds can be picked up using the projection or individually inserted in the projection. Additional views of the plunger are shown in FIGS. 11 and 12.

FIGS. 13A-K show a simplified section view of an alternate embodiment of the loader illustrating the operation of the loader to load multiple rounds of ammunition into a magazine. A typical magazine 1300 includes a tubular housing having a feed end 1302 that is received by the magazine well of the loader. The feed end 1302 terminates in a pair of feed lips 1304.

As an alternate embodiment, the slightly concave shape of the front wall lower section in the simplified sectional view is less pronounced than that seen in FIG. 7, but the operation is the same. The slightly concave shape of the front wall lower section in FIGS. 13A-K is suitable for proper operation of the loader, but more extreme concave shapes can reduce the amount of force required to operate the loader.

Figure 13A:
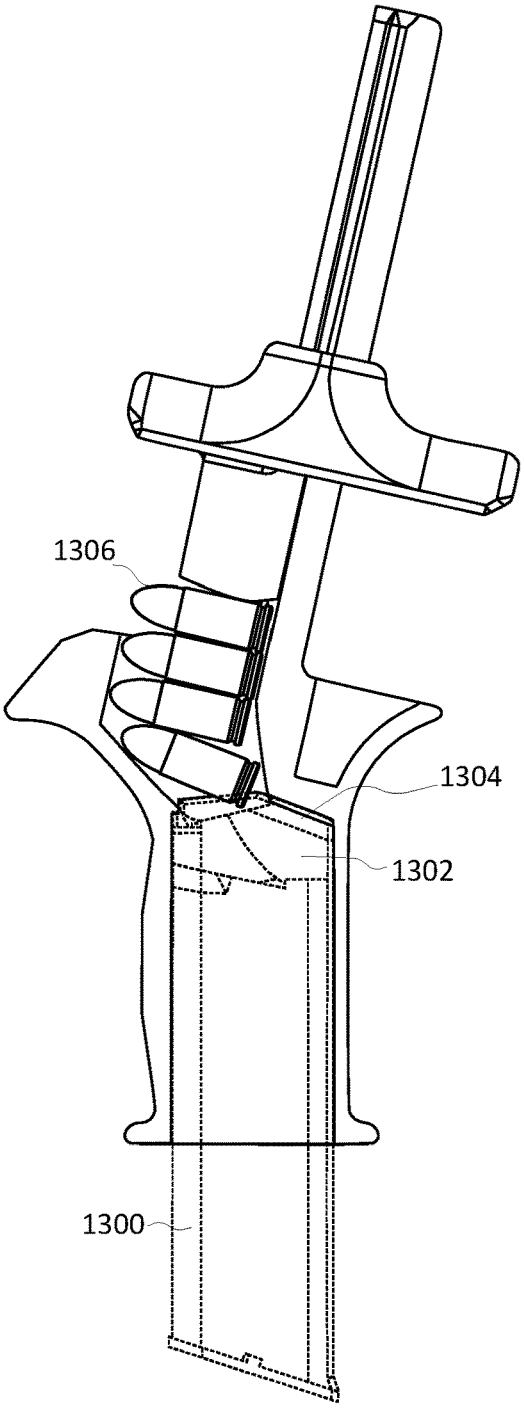
FIGS. 13A-K show a simplified cross-section illustrating the operation of the loader.
Figure 13B:
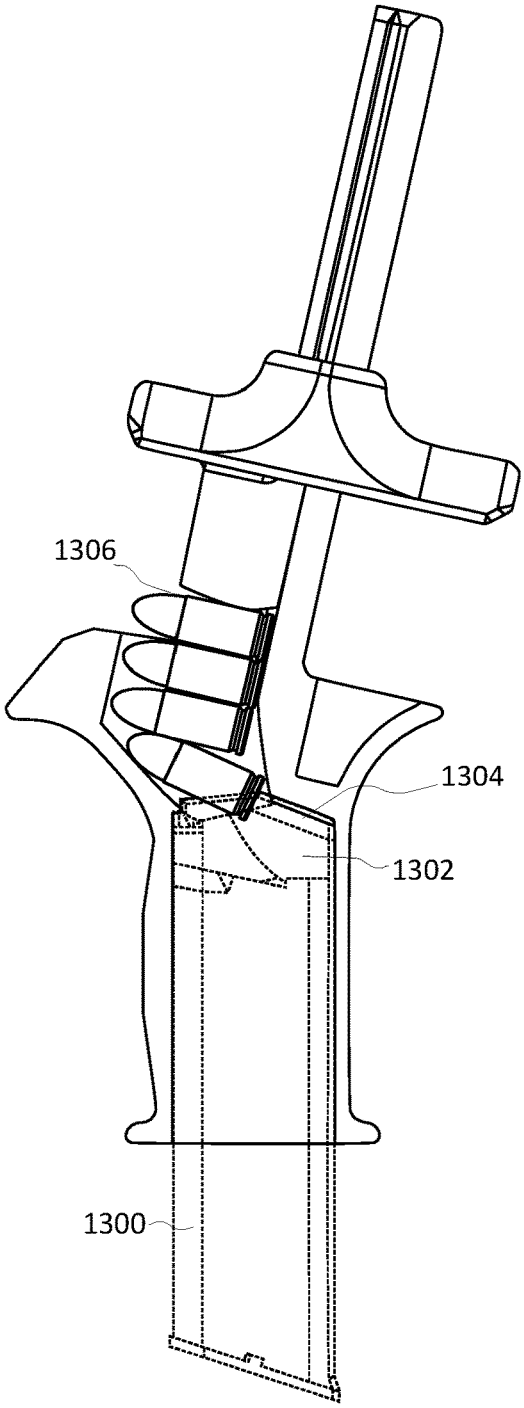
Figure 13C:
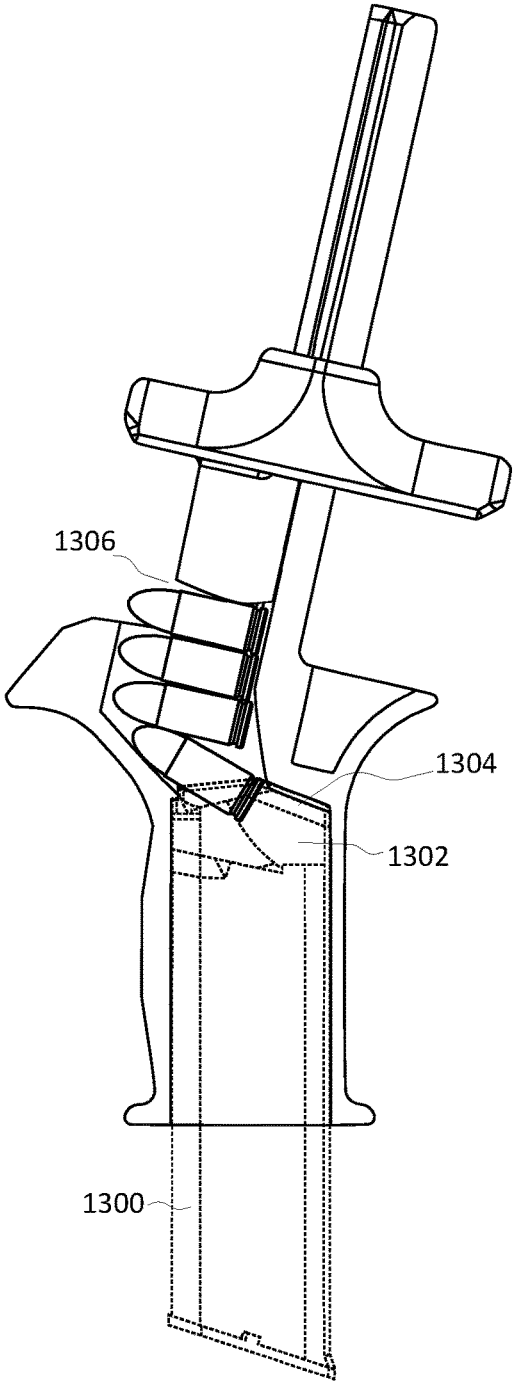
Figure 13D:
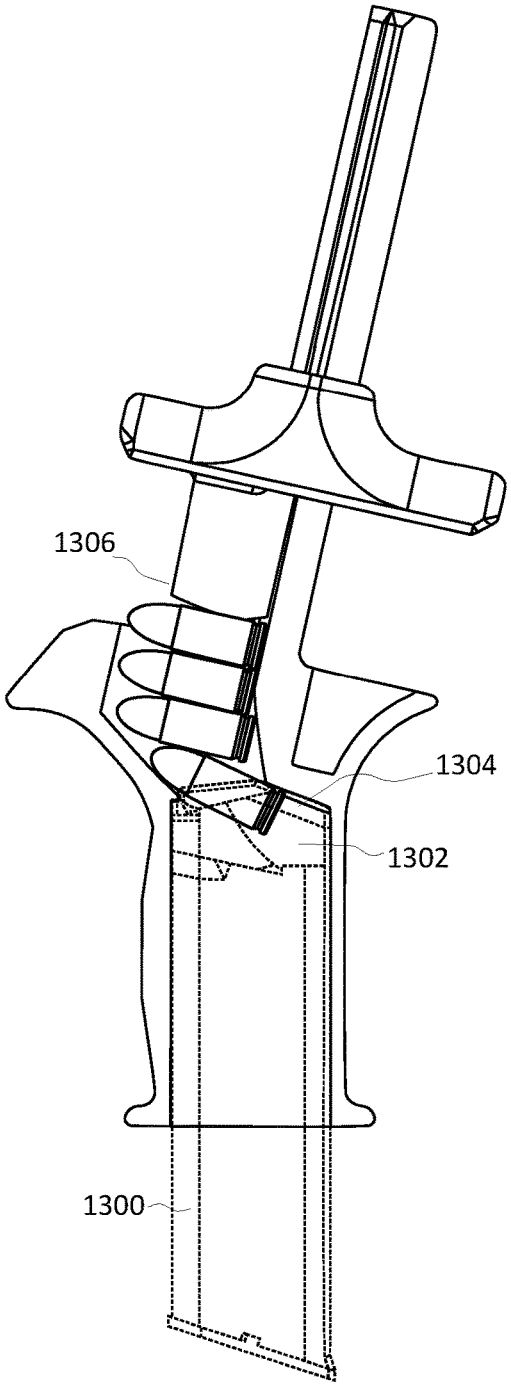
Figure 13E:
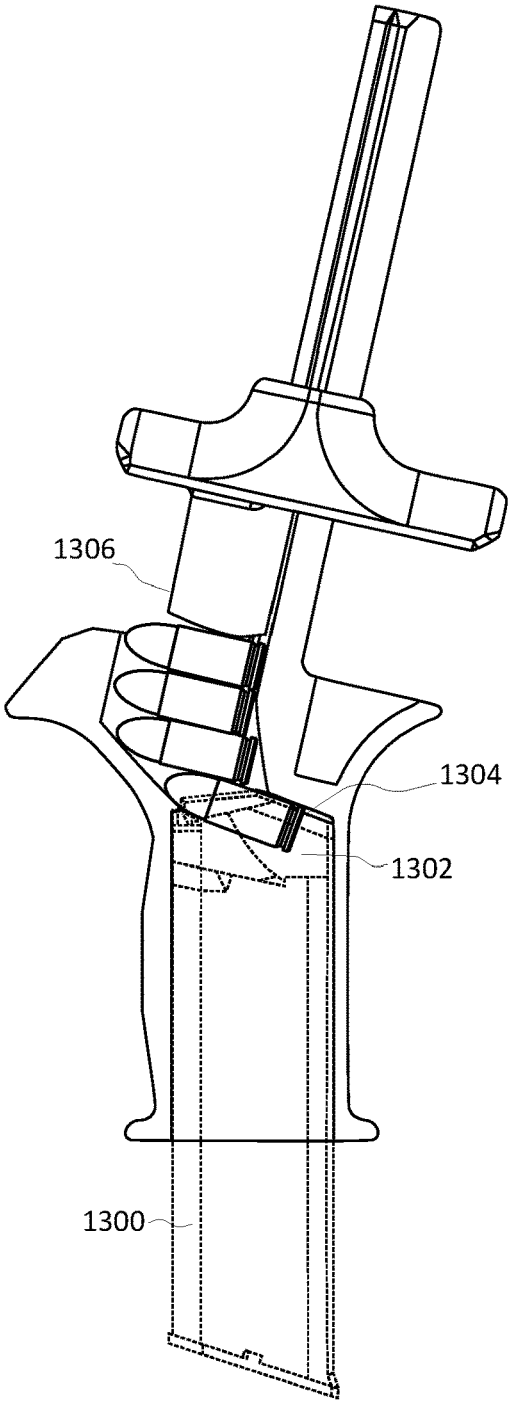
Figure 13F:
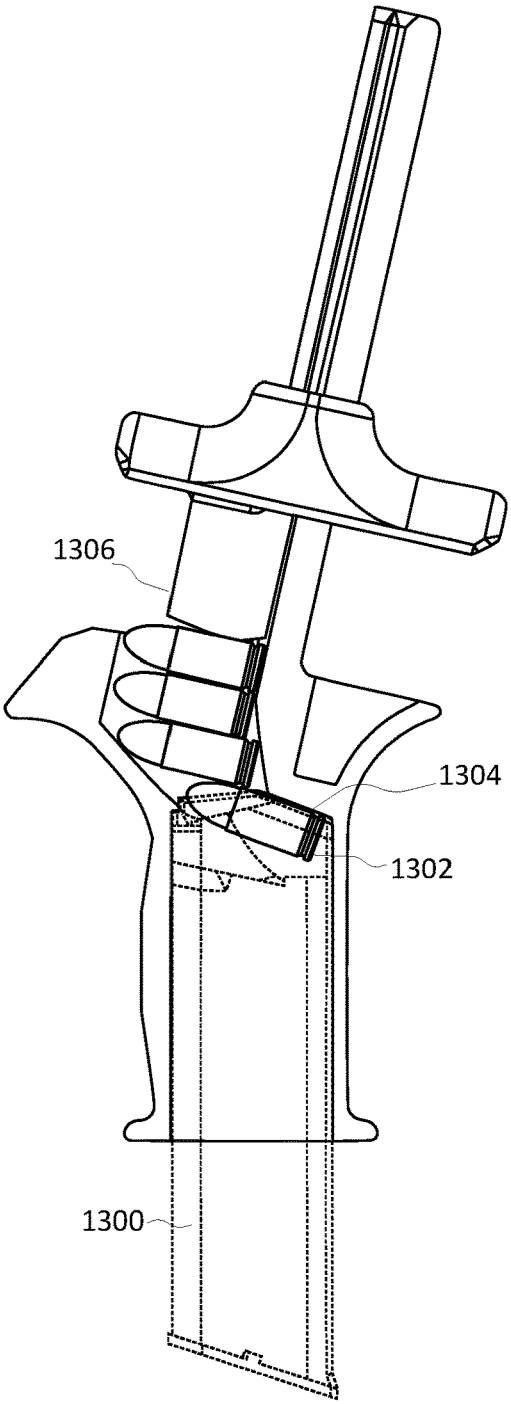
Figure 13G:
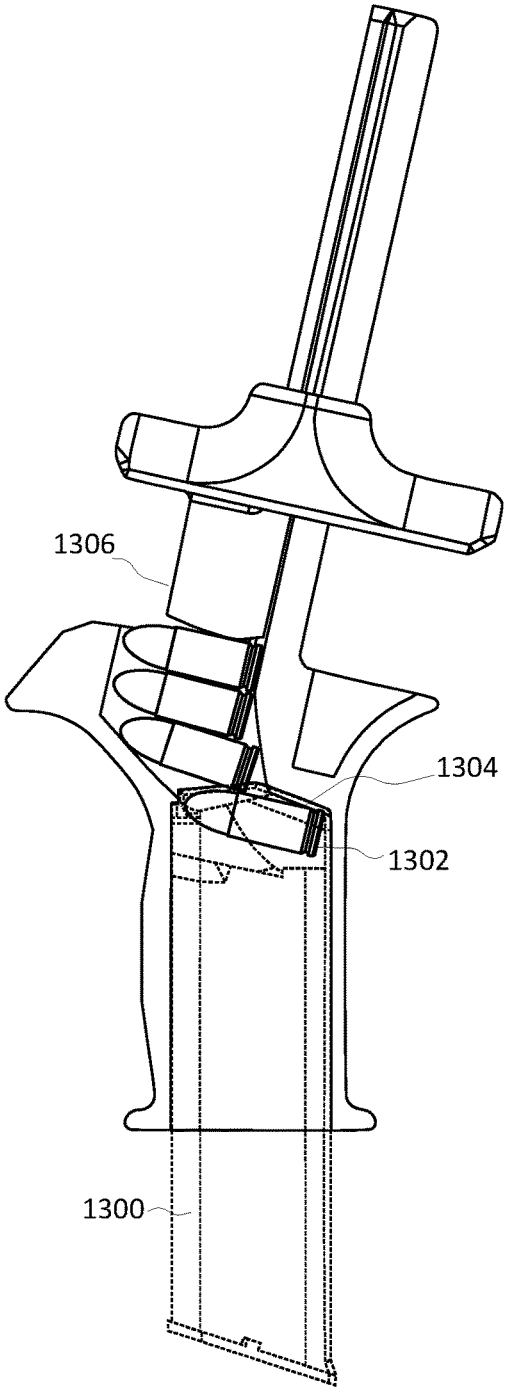
Figure 13H:
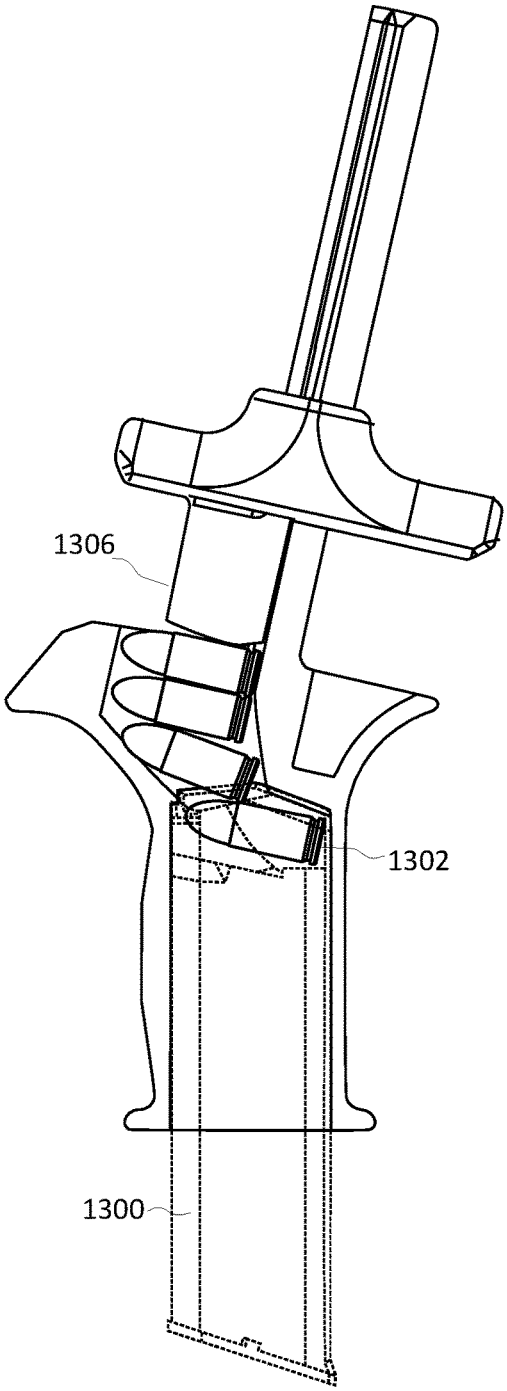
Figure 13I:
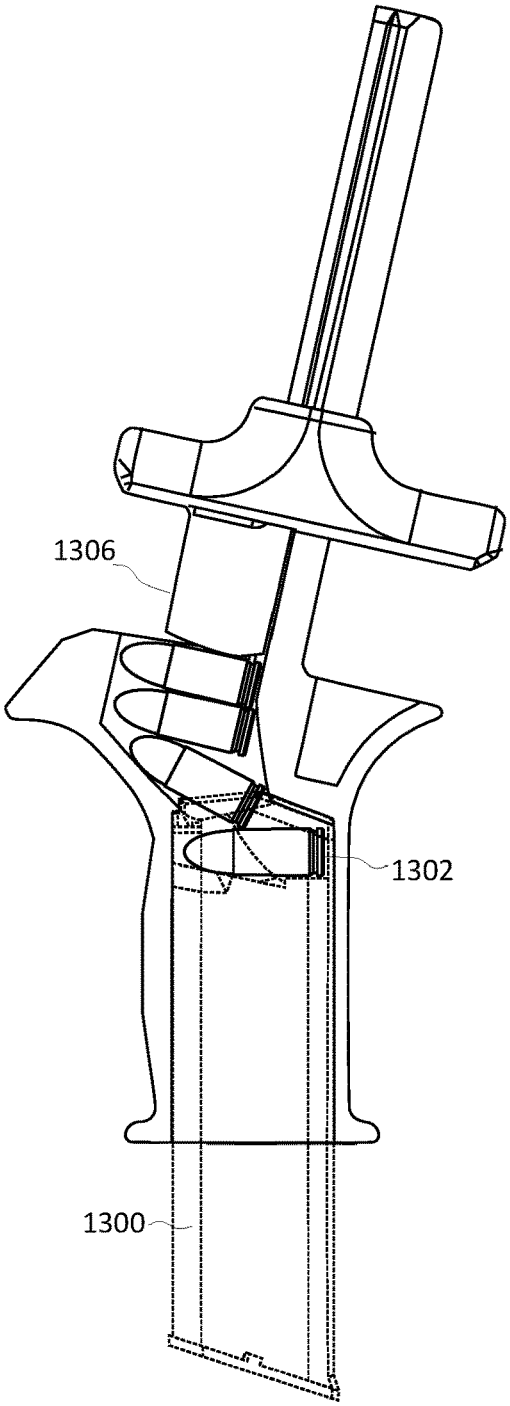
Figure 13J:
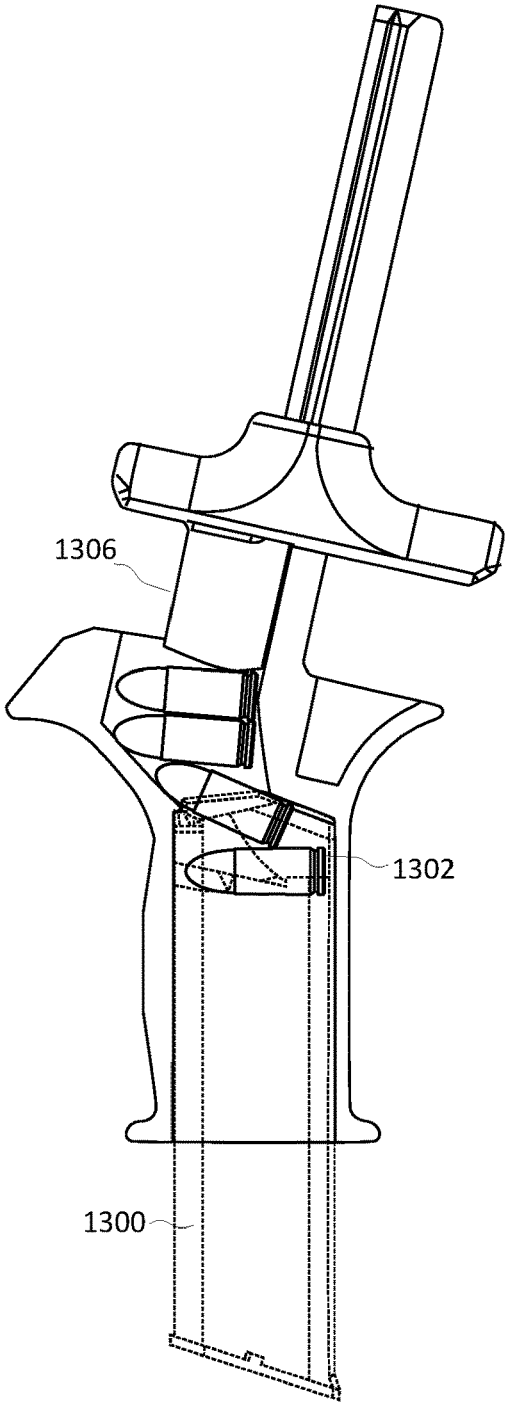
Figure 13K:
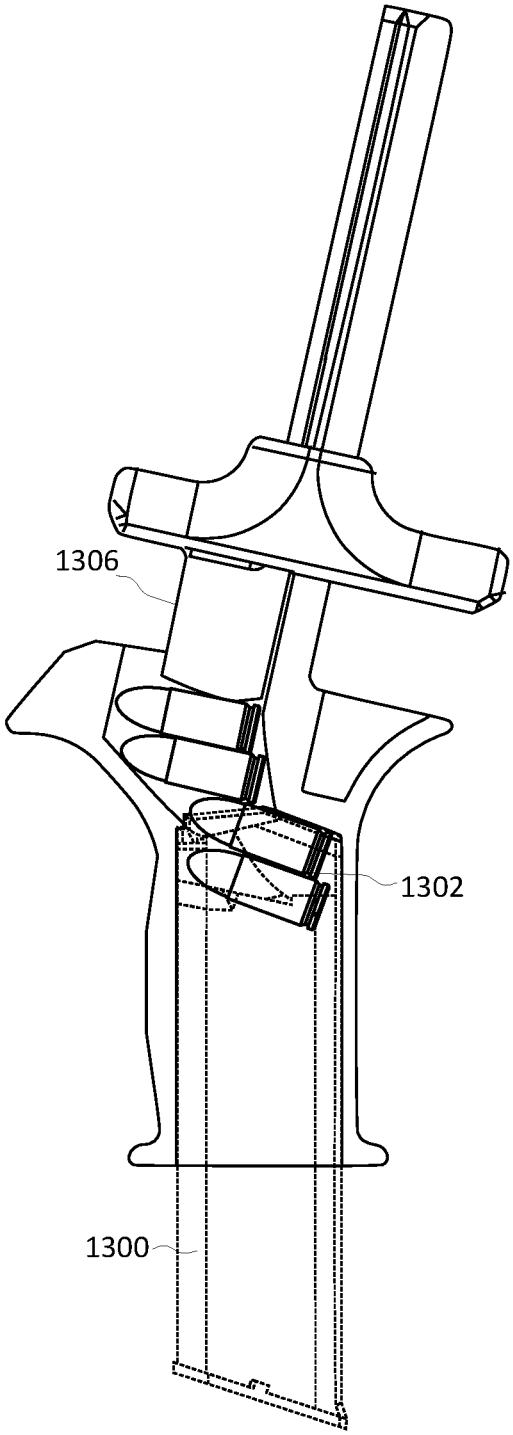

As shown in FIGS. 13A-K, when force is applied to rounds of ammunition 1306 carried by the projection 102 using the plunger 900, the walls of the round positioning chamber interact with the rounds 1306 and cause the rounds 1306 to rotate. In FIGS. 13A and 13B, the front of the bottommost round hits the round positioning chamber front wall. Because the rear of the bottommost round is beyond the rear wall top section 706*c*, the rear end of the bottommost round is free to rotate. Meanwhile, the rear wall top section (and the ribs, where applicable) prevents the upper rounds from rotating. In other words, the upper rounds are constrained and act as an extension of the push bar 908. Further, the shallower angle of the lower sections of the front wall and the force applied for the rounds above create constructive compression on the front end of the bottommost round that contribute to the rotation of the rear of the round, which is free to rotate. The lower sections of the rear wall serve to control the rotation of the rear end of the bottommost round. The angles of the rounding positioning chamber walls result in the bottommost round achieving an angle approximating the angle of the feed lips as the round reaches the end of the rounding round positioning chamber 700.

Turning to FIGS. 13C through 13F, as the rear of the bottommost round clears the rear wall, the rear wall no longer limits rotation of the rear end of the bottommost round. Instead, the lower sections of the front wall become the limiting factor of the rotation of the round. The rotation of the bottommost round approaches the angle of the lower sections of the front wall. This allows the rear end of the round to slide below the feed lips of the magazine. The force applied to the bottommost round is also transferred to the follower of the magazine, compressing the spring and moving the follower downward to make room for the round. Once the rear end of the round is below the feed lips, the force transferred from the rounds above slides the round down the front wall and seats the round down into the magazine.

Turning to FIGS. 13G through 13K, once the bottommost round has fully exited the round positioning chamber is loaded into the magazine, the next lowest round in line is freed to rotate in the same manner as described above, and the process repeats until all rounds have been loaded into the magazine. The topmost round loaded into the magazine effectively acts as an extension of the follower.

Figure 16:
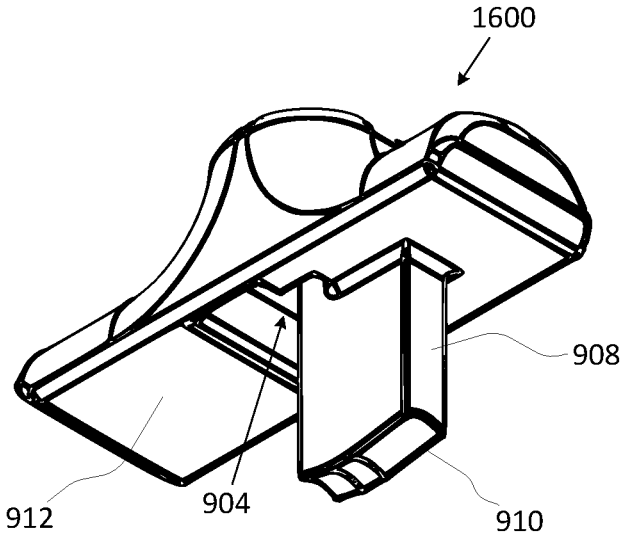
FIG. 16 is a bottom perspective view of an alternate embodiment of the plunger for use with loader.

It should be appreciated that exterior contours of the loader and the plunger can be varied for any reason, including aesthetics, cost savings, and manufacturing efficiency, without departing from the scope and spirit of the present invention. For example, many areas of the loader body and the plunger shown in FIGS. 1-12 have been hollowed (e.g., the bodies) or had material removed (e.g., the push bar) leaving only ribs as desired to provide structural support or thickness for alignment. These types of modifications reduce the amount and thickness of the material being molded, which may be required for proper injection molding. However, other manufacturing techniques are less sensitive to material thickness and such modifications need not be considered. For example, less contoured and more solid embodiments of the loader 1400 and the plunger 1600 are illustrated in FIGS. 14-16.

The above specification, examples, and data provide a complete description of the manufacture and use of the composition of the invention. Since many implementations of the invention can be made without departing from the spirit and scope of the invention, the invention resides in the claims hereinafter appended.

What is claimed is:

1. A firearm magazine loader comprising:

a body having a top end, a bottom end, a front, a rear, and two opposing sides, the body defining round positioning chamber and a magazine well, the top end defining a feed opening to the round positioning chamber, the bottom end defining a well opening to the magazine well, the magazine well configured to receive a magazine having a pair of feed lips, the round positioning chamber defined by a multi-sectional front wall and a rear wall, the lower section of the front wall and at least a portion of the rear wall being at different angles causing the round positioning chamber to narrow such that a round of ammunition must pivot to pass through the round positioning chamber;

a projection extending from the top end of the body proximate to the rear of the body, the projection, the projection having a pair of rails, each rail having a rib configured to operatively engage an extraction groove in a round of ammunition allowing the projection to carry the round of ammunition into the round positioning chamber; and at least one frontal positioner configured to position a magazine inserted into the magazine well toward the rear of the magazine well.

2. The firearm magazine loader of claim 1 wherein the lower section of the front wall of the round positioning chamber has a generally concave shape.

3. The firearm magazine loader of claim 1 wherein a lower portion of the rear wall of the round positioning chamber has a generally convex shape.

4. The firearm magazine loader of claim 1 wherein the lower section of the front wall of the round positioning chamber has a first section and a second section, the first section being proximate to the upper section of the front wall of the round positioning chamber, the second section being proximate to the magazine well, the relative angle between the second section and the upper section of the front wall of the round positioning chamber is smaller than the relative angle between the first section and the upper section of the front wall of the round positioning chamber.

5. The firearm magazine loader of claim 1 further comprising a pair of a lateral positioners configured to laterally center a magazine inserted into the magazine well.

6. The firearm magazine loader of claim 5 wherein the frontal positioner and each lateral positioner comprises:

an inner face, the frontal positioner having a resting position wherein the inner face is in line with the side of the body of which the frontal positioner is a part;

a ridge projecting from the inner face configured to engage the magazine inserted into the magazine well and reduce the contact area between the magazine and the inner surfaces of the magazine well; and a fixed edge portion connected to the body, the remaining edge portions being disconnected from the body such that the lateral positioner flexes proximate to the edge portion and provides a force resisting outward movement of the lateral positioner due to forces applied to the ridge by the magazine inserted into the magazine well.

7. The firearm magazine loader of claim 1 further comprising feed lip guides, the feed lip guides having at least one vertical ridge located on an upper portion of a side wall of the magazine well proximate to the rear of the body.

8. The firearm magazine loader of claim 1 further comprising a lip proximate to the bottom of the front wall of the round positioning chamber, the lip configured to extend out over the front wall of a magazine inserted into the magazine well.

9. The firearm magazine loader of claim 1 further comprising a plunger having a push bar, the push bar configured to operatively engage and apply force to a round of ammunition so as to push the round of ammunition at least partially through the round positioning chamber, the force applied through the push bar causing the front end of the round of ammunition to engage the at least one front wall lower section and the rear end of the round of ammunition to rotate downward until the rear end of the round of ammunition slides under the feed lips of the magazine and sliding the round of ammunition rearward until seated in the magazine.

10. A firearm magazine loader comprising:

a body defining a magazine well and a round positioning chamber, the magazine well configured to receive a magazine having a pair of feed lips, the round positioning chamber having a front wall and a rear wall, the front wall having an upper section and a lower section, the lower section of the front wall of the round positioning chamber having a generally concave shape;

a projection having a pair of rails, each rail having a rib configured to operatively engage an extraction groove in a round of ammunition allowing the projection to carry the round of ammunition for loading into a magazine; and a plunger having a body and a push bar, the plunger body configured to operatively engage and slide along the projection, the push bar configured to operatively engage and apply force to a round of ammunition so as to push the round of ammunition at least partially through the round positioning chamber.

11. The firearm magazine loader of claim 10 wherein the push bar has a curved bottom face.

12. The firearm magazine loader of claim 10 wherein the plunger body defines an opening for receiving the projection and the push bar is centered between the rails when the plunger body is riding on the projection.

13. The firearm magazine loader of claim 10 further comprising at least one frontal positioner configured to position a magazine inserted into the magazine well toward the rear of the magazine well, the frontal positioner defined by the front side of the body.

14. The firearm magazine loader of claim 13 further comprising a pair of a lateral positioners configured to laterally center a magazine inserted into the magazine well, each lateral positioner defined by one side of the body.

15. The firearm magazine loader of claim 14 wherein the frontal positioner and each lateral positioner comprise:

a tab flexibly connected to the body and resisting outward movement of the positioner due to forces applied to the tab by the magazine inserted into the magazine well; and a ridge projecting from an inner face of the tab, the ridge configured to engage the magazine inserted into the magazine well.

16. The firearm magazine loader of claim 10 further comprising a lip proximate to the bottom of the front wall of the round positioning chamber, the lip configured to extend out over the front wall of a magazine inserted into the magazine well.

17. A firearm magazine loader comprising:

a body defining a magazine well and a round positioning chamber, the magazine well configured to receive a magazine having a pair of feed lips, the round positioning chamber having a multi-sectional front wall and a rear wall, the front wall having a middle section oriented at a first obtuse angle relative to the top section of the front wall, the front wall having a lower section oriented at a second obtuse angle relative to the top section of the front wall, the first obtuse angle being larger than the second obtuse angle;

a projection having a pair of rails, each rail having a rib configured to operatively engage an extraction groove in a round of ammunition allowing the projection to carry the round of ammunition for loading into a magazine; and a plunger having a body and a push bar, the plunger body configured to travel along the projection, the push bar configured to operatively engage and apply force to a round of ammunition so as to push the round of ammunition at least partially through the round positioning chamber.

18. The firearm magazine loader of claim 17 further comprising a vertical groove in the center of the rear wall of the round positioning chamber.

19. The firearm magazine loader of claim 17 further comprising a pair of a lateral positioners configured to laterally center a magazine inserted into the magazine well and at least one frontal positioner configured to position a magazine inserted into the magazine well toward the rear of the magazine well.

20. The firearm magazine loader of claim 17 wherein the rear wall is a multi-sectional rear wall having a middle section oriented at a third obtuse angle relative to the top section of the front wall and a lower section oriented at a fourth obtuse angle relative to the top section of the front wall, the third obtuse angle being smaller than the fourth obtuse angle.

* * * * *